US007976247B1

(12) United States Patent
Trent et al.

(10) Patent No.: US 7,976,247 B1
(45) **Date of Patent: *Jul. 12, 2011**

(54) DUAL PRESSURE CYLINDER

(75) Inventors: David Trent, Cypress, TX (US); Robert Magee Shivers, III, Houston, TX (US); Charles C. Trent, San Antonio, TX (US)

(73) Assignee: ATP Oil & Gas Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/612,474

(22) Filed: Nov. 4, 2009

(51) Int. Cl.
*E21B 43/01* (2006.01)

(52) U.S. Cl. ..... 405/224.4; 405/223.1; 166/355; 92/85 B

(58) Field of Classification Search ..... 405/224.4, 405/223.1; 166/345, 359, 350, 367, 355; 175/10; 92/151, 142, 81, 168, 110, 85 B
See application file for complete search history.

(56) References Cited

U.S. PATENT DOCUMENTS

| | | | |
|---|---|---|---|
| 6,554,072 | B1 | 4/2003 | Mournian et al. |
| 6,554,992 | B1 | 4/2003 | Smith |
| 2008/0210108 | A1 | 9/2008 | Hahn et al. |

*Primary Examiner* — John Kreck
*Assistant Examiner* — Sean Andrish
(74) *Attorney, Agent, or Firm* — Buskop Law Group, PC; Wendy Buskop

(57) ABSTRACT

A self contained dual pressure cylinder for use in tensioner assemblies for oil and natural gas floating vessels. The self contained dual pressure cylinder can have a high pressure outer barrel surrounding a high pressure inner barrel, forming a high pressure gas channel, a low pressure outer barrel surrounding a low pressure inner barrel, forming a low pressure fluid channel. A high pressure gas port connected to a high pressure gas reservoir, a low pressure fluid port connected to a low pressure gas reservoir, a low pressure fluid compression area connected to the low pressure fluid port, a hollow rod slidingly engaged each inner barrel, a dual pressure capture plate with moveable rod seals and moveable rod wear, a piston a low pressure elastomeric seal, a low pressure/high pressure separator, and a high pressure elastomeric seal.

17 Claims, 11 Drawing Sheets

FIGURE 4A
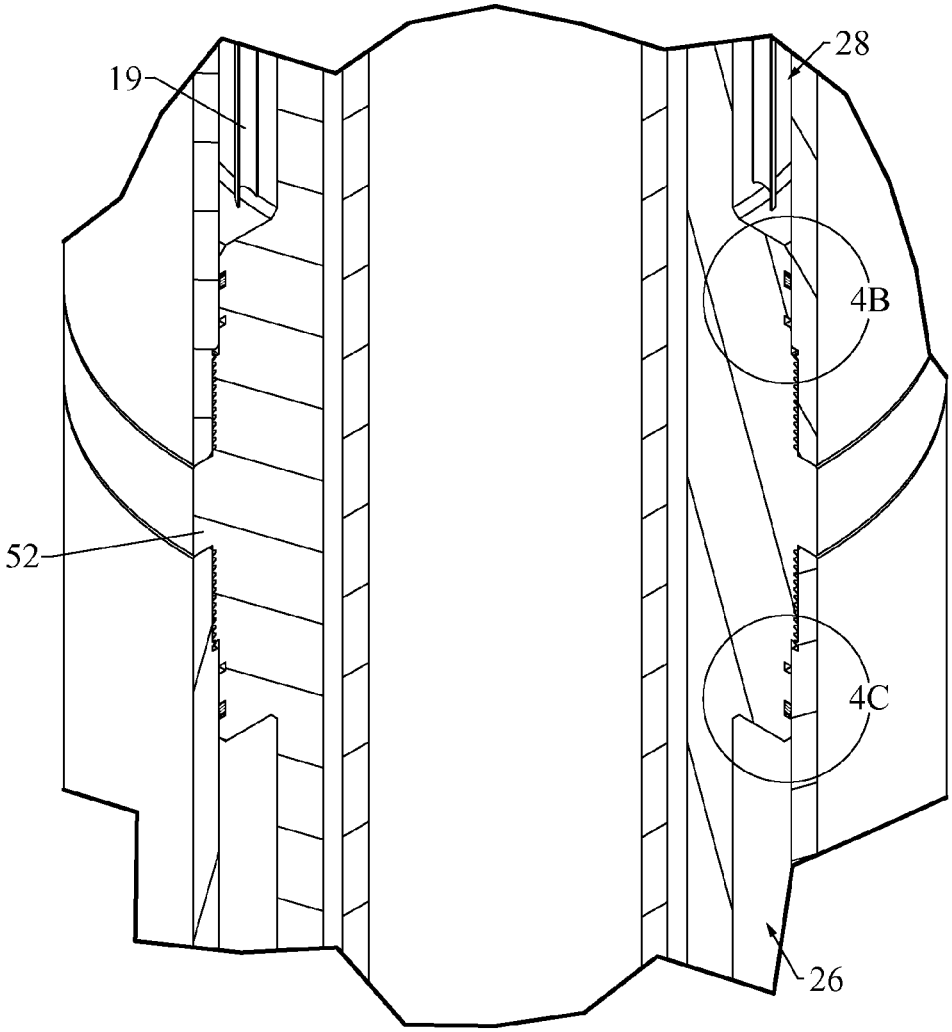
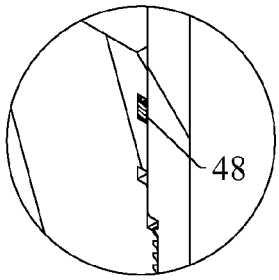
FIGURE 4B
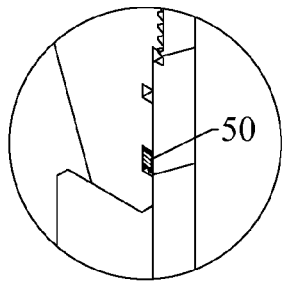
FIGURE 4C

DUAL PRESSURE CYLINDER

FIELD

The present embodiments generally relate to a self contained dual pressure cylinder usable with a tensioner assembly for offshore oil and natural gas floating platforms and drill ships.

BACKGROUND

A need exists for a cylinder that can be used in groups of cylinders that is easy to use, easy to maintain, and simultaneously provides two different features when engaged with a tensioner assembly for a drill ship, a drilling platform, a work over platform, or a similar device usable in the oil and natural gas industries.

A need has long existed for a cylinder usable in a tensioner assembly for drilling casing that can properly and safely tension a floating platform in heavy seas, such as a 100 year storms.

A need exists for a cylinder that is modular, portable, is not co-dependant on other cylinders, and can be independently operable.

The present embodiments meet these needs.

BRIEF SUMMARY OF THE INVENTION

N/A

BRIEF DESCRIPTION OF THE DRAWINGS

The detailed description will be better understood in conjunction with the accompanying drawings as follows:

FIG. 3 is

FIGS. 4A-4C show a detailed view of a low pressure elastomeric seal with a low pressure/high pressure separator.

Figure 1A:
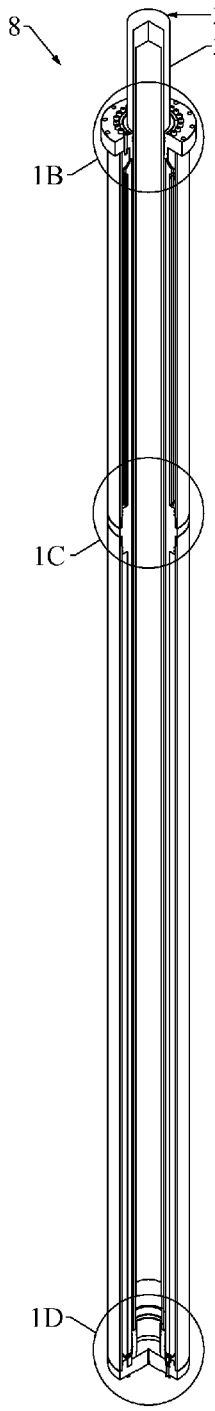
FIGS. 1A-1D show a cut view of a dual pressure cylinder.
Figure 1B:
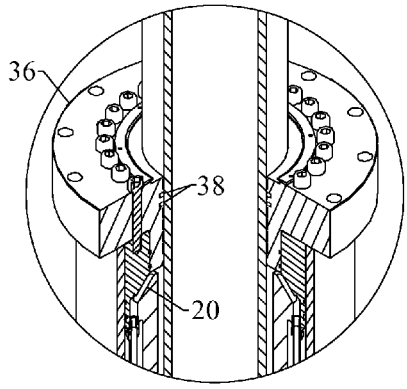
Figure 1C:
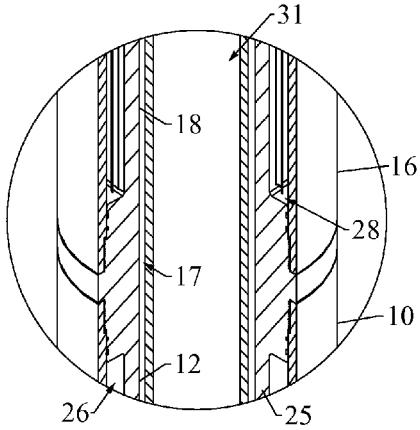
Figure 1D:
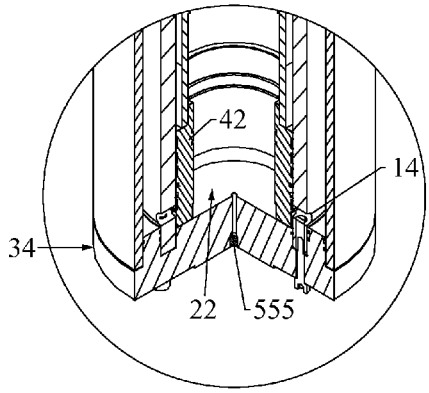

The present embodiments are detailed below with reference to the listed Figures.

DETAILED DESCRIPTION OF THE EMBODIMENTS

Before explaining the present device in detail, it is to be understood that the device is not limited to the particular embodiments and that it can be practiced or carried out in various ways.

The present embodiments relate to a dual pressure cylinder that can simultaneously provide two different pressures and can monitor those pressures to ensure safe operation. Each dual pressure cylinder can be independent of other dual pressure cylinders being used simultaneously in the same tensioner assembly.

The dual pressure cylinders can provide longer operation of a tensioner assembly because the tensioner assembly with the dual pressure cylinders can continue to operate even when one of the dual pressure cylinder malfunctions.

The dual pressure cylinders can provide easy maintenance, as a single dual pressure cylinder can be replaced while the tensioner assembly continues to operate. The dual pressure cylinders can be replaced while the tensioner assembly is operating at sea.

The dual pressure cylinders can simultaneously provide two different pressures for tensioning, which provides for a safer device than cylinders that simply have high pressure applications.

The dual pressure cylinders can be self contained, and can reduce the risks associated with the handling of equipment in a splash zone of an offshore platform as the dual pressure cylinders can be removed without the need of more than one person to disconnect the dual pressure cylinder from the tensioner assembly.

One of the benefits of the invention is that fewer parts are needed to operate a tensioner assembly, therefore there are fewer valves to break, there is no piping to separate from other valving and there are no pumps needed.

An embodiment of the dual pressure cylinders prevent the need for external piping, valves, and compressed air bottles on a rig. The dual pressure cylinders do not require plumbing from external bottles. This is beneficial because the lines of plumbing that require external bottles can be damaged in a high sea or a storm if the dual pressure cylinders are installed on a floating vessel.

Still another benefit of the dual pressure cylinder is that no exposed parts are on deck while a hand is working or maintaining the dual pressure cylinder.

The embodiments relate to a self contained dual pressure cylinder for use in tensioner assemblies for oil and natural gas floating vessels.

A high pressure outer barrel surrounds a high pressure inner barrel and forms a high pressure gas channel. A low pressure outer barrel surrounds a low pressure inner barrel and forms a low pressure fluid channel. The low pressure outer barrel adjoins the high pressure outer barrel and the low pressure inner barrel adjoins the high pressure inner barrel.

A high pressure gas port is connected to a high pressure gas reservoir, and a low pressure fluid port is connected to a low pressure gas reservoir.

A low pressure fluid compression area is connected to the low pressure fluid port.

A moveable hollow rod slidingly engages within the inside the high pressure inner barrel and the inside of the low pressure inner barrel. The moveable hollow rod has a first end for engaging a load bucket of the tensioner assembly.

The moveable hollow rod can have a chamber, which can be fluidly connected to the high pressure gas reservoir and enables the moveable hollow rod to support a load.

A dual pressure capture plate seals the moveable hollow rod inside the high pressure inner barrel and inside the low pressure inner barrel with moveable rod seals and moveable rod wear bands.

A piston can be fastened to the moveable hollow rod second end opposite to the tensioner assembly and enables the cylinder to provide foot strokes between about 6 feet to about 45 feet.

The dual pressure cylinder can include a low pressure/high pressure separator with a low pressure elastomeric seal adjacent to the low pressure/high pressure separator. A high pressure elastomeric seal can also be disposed adjacent to the low pressure/high pressure separator. The low pressure/high pressure separator provides a non-deforming separation between the high pressure gas reservoir and the low pressure gas reservoir.

In embodiments, the piston can have a piston body with plurality of moveable rod wear bands and a plurality of moveable rod seals for sealing between the piston body and the high pressure inner barrel and sealing between the piston body and the low pressure inner barrel.

In embodiments, the piston can include a piston drain port, a piston end cap, and a plurality of piston end cap fasteners to hold the piston end cap to the high pressure inner barrel. Embodiments can include at least one piston wear band, at least one piston seal adjacent to the piston wear band, and at least one piston seal groove for containing one of the piston seals.

It can be noted that the high pressure gas channel can have a pressure from about 100 psi to about 3600 psi.

The high pressure gas within the high pressure gas channel can be an expandable gas, such as nitrogen, air, helium, argon, or combinations thereof.

The low pressure fluid channel can have from about 20 percent to about 70 percent liquid with the remainder of the low pressure fluid channel being a gas.

The gas of the low pressure fluid channel can be nitrogen, air, helium, argon, or combinations thereof, which can flow over the liquid. The liquid can be a liquid glycol, a hydraulic liquid, a mineral based liquid lubricant, a silicon liquid, or a glycol based liquid lubricant, or combinations thereof. The liquid lubricants can be a white oil, a silicon oil, a mineral oil, or combinations thereof.

The dual pressure cylinder can include a low pressure access port with a low pressure closable fitting, a high pressure access port with a high pressure closable fitting, a controller with a controller processor, and controller data storage for storing preset pressure limits. The controller data storage can also have controller computer instructions for opening or closing the fittings.

A high pressure sensor can be disposed between the high pressure closable fitting and the controller and can be in communication with the controller. The controller can increase or decrease pressure within the high pressure gas channel based on preset pressure limits stored in the controller data storage.

A low pressure sensor can be disposed between the low pressure closable fitting and the controller while remaining in communication with the controller to increase or decrease pressure within the low pressure gas channel based on preset pressure limits stored in the controller data storage.

The controller processor can communicate with a network for remotely controlling the pressures within the high pressure gas channel and the low pressure fluid channel. The pressures can be controlled using a client device, such as a cellular phone or a lap top, that can be in communication with the controller processor through the network.

The client device can further have client device computer instructions for presenting an executive dashboard to a user that allows for simultaneous monitoring of a plurality of self contained dual pressure cylinders continuously.

The high pressure outer barrel and the low pressure inner barrel each can be made from a high strength low carbon alloy, a composite of carbon fiber, a synthetic fiber with an epoxy resin, or combinations thereof.

The high pressure outer barrel can be made from a high strength low carbon alloy, a composite of carbon fiber, a composite of a synthetic fiber with an epoxy resin, or combinations thereof.

The low pressure inner barrel can include a material different from the high pressure barrel, providing a dual pressure cylinder with two different physical properties due to two different materials, which allows the dual pressure cylinder to have strength with low weight, or high impact strength with flexibility.

Each outer barrel can be threaded to each respective inner barrel.

In embodiments, the high pressure gas channel can have a diameter from about 10 percent to about 24 percent smaller than the low pressure fluid channel.

Turning now to FIGS. 1A-1D, the dual pressure cylinder 8 is made from a high pressure outer barrel 10 surrounding a high pressure inner barrel 12 to form a high pressure gas channel 14.

As an example, the high pressure outer barrel 10 can be made of steel and have a thickness from about ¾ inches to about 2 inches, and the high pressure gas channel 14 can contain a high pressure gas, such as nitrogen at a pressure from about 500 psi to about 3000 psi. The high pressure inner barrel 12 can be made of cold rolled steel.

The high pressure outer barrel 10 can be coated with thermal sprayed aluminum or with marine paint with inorganic zinc primer as a base for cathodic protection. Similarly, the high pressure outer barrel can have a sacrificial anode for enhanced cathodic protection, which lowers maintenance issues.

The high pressure gas channel 14 between the high pressure inner barrel 12 and the high pressure outer barrel 10 can have a diameter from about 1 inch to about 4 inches.

The high pressure inner barrel 12 can be made of a different substance from the high pressure outer barrel to allow two different physical properties to be imparted to the gas channel.

The high pressure inner barrel 12 provides a space for a moveable hollow rod 30 to move up and down between the high pressure inner barrel 12 and a low pressure inner barrel 18.

The moveable hollow rod 30 can have a variable diameter depending on the load that needs to be supported by the moveable hollow rod from a tensioner table.

In an example, the high pressure inner barrel 12 and the low pressure inner barrel 18 can have a thickness from about 1 inch to about 2 inches, however the thickness is variable for larger or smaller loads.

Adjacent to the high pressure outer barrel 10 is a low pressure outer barrel 16 surrounding the low pressure inner barrel 18 to form a low pressure gas channel 20. The high pressure inner barrel 12 and the high pressure outer barrel 10 are disposed in sequence with the corresponding low pressure inner barrel 18 and the low pressure outer barrel 16.

Like the high pressure outer barrel, the low pressure outer barrel can be constructed from a material that is more impact resistant than the corresponding high pressure inner barrel and the low pressure inner barrel.

In embodiments, the high pressure outer barrel or the low pressure outer barrel can have a thickness greater than the corresponding high pressure inner barrel or low pressure inner barrel. The larger the diameter of the high pressure outer barrel or low pressure outer barrel, the more wall thickness is required to support the load.

In embodiments, the high pressure outer barrel and the low pressure outer barrel can have the same thickness, as can the high pressure inner barrel and the low pressure inner barrel. It can be noted that in embodiments, the high pressure inner barrel and the low pressure inner barrel can be about 50 percent thinner than the corresponding high pressure outer barrel and low pressure outer barrel.

A high pressure gas port 22 is connected to the high pressure gas channel 14. The high pressure gas port 22 can receive compressed gas. In embodiments, gas and gas/liquid reservoirs can connect to the ports. A high pressure gas reservoir 26 can connect to the high pressure gas port 22. The high pressure gas reservoir 26 acts as a high pressure accumulator. A low pressure gas reservoir 28 simultaneously acts as a low pressure accumulator, and can be in fluid communication with a low pressure fluid port 17.

The moveable hollow rod 30 has a hollow chamber 31 for receiving the high pressure gas. The hollow chamber 31 is shown extending the length of the moveable hollow rod 30 for receiving the high pressure gas to provide additional volume to a tensioner assembly, which increases tensioner stiffness without need for external bottles of gas.

The moveable hollow rod 30 slides within the high pressure inner barrel 12 and the low pressure inner barrel 18. The moveable hollow rod has a first end 32 for engaging a tensioner system, such as a tensioner table attached to wellhead equipment on a floating vessel or similar floating platform.

Figure 3A:
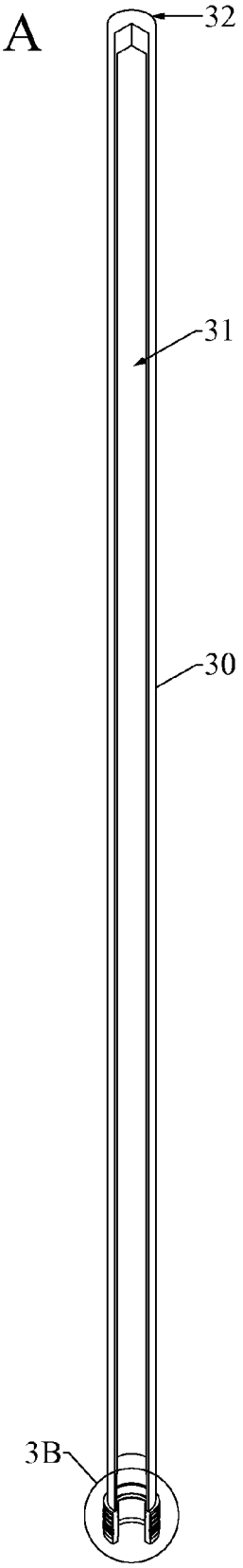
FIGS. 3A-3B show a detailed view of a moveable hollow rod.
Figure 3B:
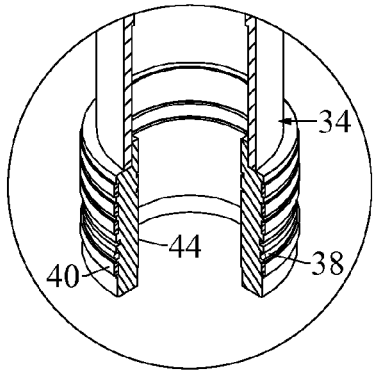

A dual pressure capture plate 36 with moveable rod seals 38 and moveable rod wear bands 40, which is shown in more detail in FIGS. 3A-3B, moveably seals the moveable hollow rod inside the high pressure inner barrel or the low pressure inner barrel.

The dual pressure capture plate 36 can be made of a low carbon alloy steel, such as a plate from about 2 inches to about 4 inches thick steel. The dual pressure capture plate enables the dual pressure cylinder to be attached to a housing for supporting a multitude of dual pressure cylinders. The dual capture plate provides access for charging and venting the dual pressure cylinders.

The moveable rod seals 38 can be made from polycarbonate, Teflon™, polyamide, or elastomeric material. The moveable rod seals can be circular bands with a thickness adequate to provide a sealing condition between the dual pressure capture plate and the moveable hollow rod.

A piston 42 is shown fastened to a second end 34 of the moveable hollow rod opposite the tensioner assembly thereby forming the dual pressure self contained cylinder adapted to provide strokes from about 6 feet to about 35 feet in length.

The piston 42 provides a seal between the high pressure side and the low pressure side of the inner barrels. In an embodiment, the piston can be a solid cylindrical ring. A plug 555 can seal a piston drain port.

FIGS. 1A-1D also show a high pressure compression area 25.

Figure 2A:
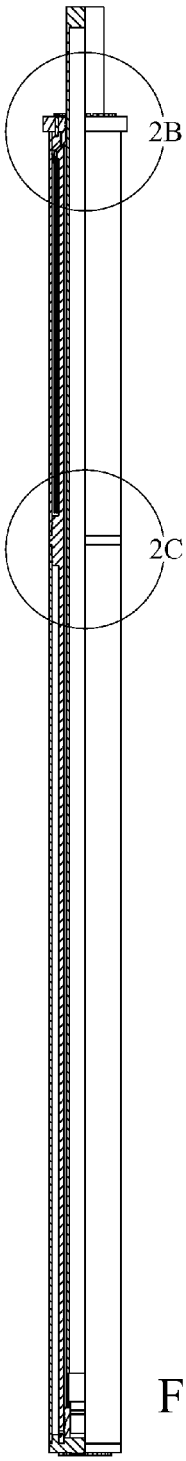
FIGS. 2A-2B show a side view of a dual pressure cylinder.
Figure 2B:
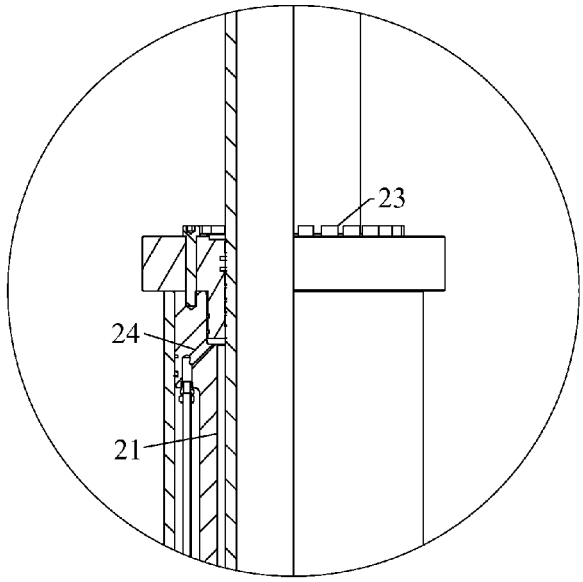
Figure 2C:
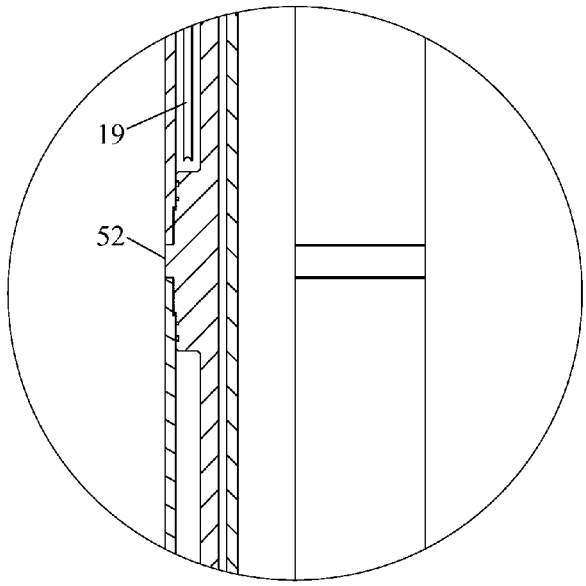

FIGS. 2A-2C show the low pressure port 24 that connects to the low pressure gas channel. The low pressure port receives compressed gas and liquid at a pressure. The low pressure gas reservoir can also connect to the low pressure gas port.

The low pressure/high pressure separator 52 can be built into the outside of the high pressure inner barrel and on the outside of the low pressure inner barrel. The low pressure/high pressure separator can be made of the same material as the high pressure inner barrel and low pressure inner barrel. The low pressure/high pressure separator can be a wall, and it can have the same thickness to seal the high pressure inner barrel and low pressure inner barrel with the corresponding high pressure outer barrel and low pressure outer barrel.

The low pressure/high pressure separator is static. Static, as used herein, refers to a low pressure/high pressure separator that does not move to the inside of the outer barrels.

FIGS. 2A-2B also show the low pressure compression area 21 of the dual pressure cylinder and a high pressure regulatory access port 23. A cross section of the separator 52 described above is shown as well as a low pressure standpipe 19. The low pressure standpipe allows liquid from the low pressure inner barrel to have a means to transfer back and forth from the low pressure outer barrel through the low pressure port.

FIGS. 3A-3B show the moveable hollow rod 30 with the hollow chamber 31 and the first end 32 of the moveable hollow rod. Also shown is a piston body 44 with the moveable rod seals 38 and the moveable rod wear bands 40. This Figure also shows the second end 34 of the moveable hollow rod adjacent the piston body 44.

FIGS. 4A-4C show the low pressure/high pressure separator 52 and the low pressure elastomeric seal 48 adjacent to the low pressure/high pressure separator.

A high pressure elastomeric seal 50 is shown disposed on the opposite side from to the low pressure/high pressure separator 52. The low pressure/high pressure separator provides a solid wall. Additionally, the low pressure gas reservoir 28 is shown adjacent to the low pressure elastomeric seal 48, and the high pressure gas reservoir 26 is shown on the opposite side of the high pressure elastomeric seal 50. The low pressure standpipe 19 is also shown.

The low pressure/high pressure separator 52 provides a non-deforming separation between the high pressure gas channel and the low pressure gas channel, as well as a non-deforming separation between the low pressure compression area and the high pressure compression area.

Figure 5A:
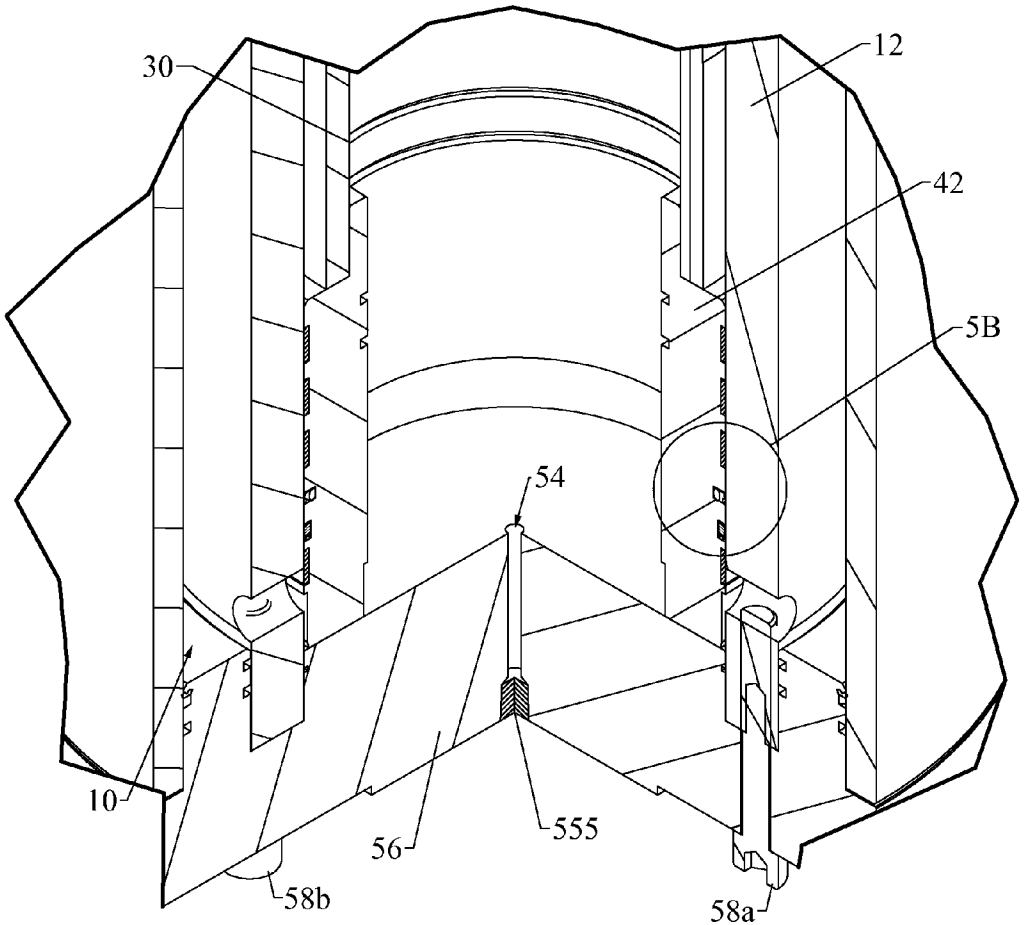
FIGS. 5A-5B show a detailed view of a piston portion of a dual pressure cylinder.
Figure 5B:
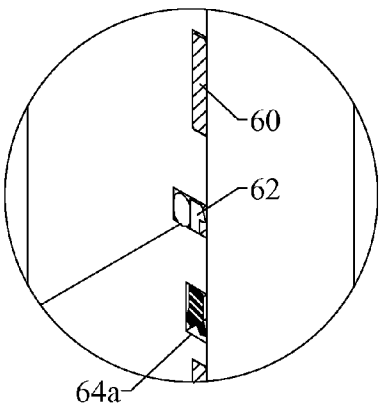

FIGS. 5A-5B show a detail of the piston 42 attached to the moveable hollow rod 30. Also shown is the high pressure outer barrel 10, a piston drain port 54, a piston end cap 56, and a plurality of piston fasteners 58*a*, 58*b*. Piston fastener 58*a* is shown holding the piston end cap 56 to the high pressure inner barrel 12. A piston wear band 60 is shown adjacent and in tandem with a piston seal 62.

Multiple piston wear bands and multiple piston seals can be used. Similarly, a primary piston seal and a secondary piston seal can be formed, each within a piston seal groove 64*a*.

The piston drain port 54 operates with a plug 555 disposed therein.

Figure 6:
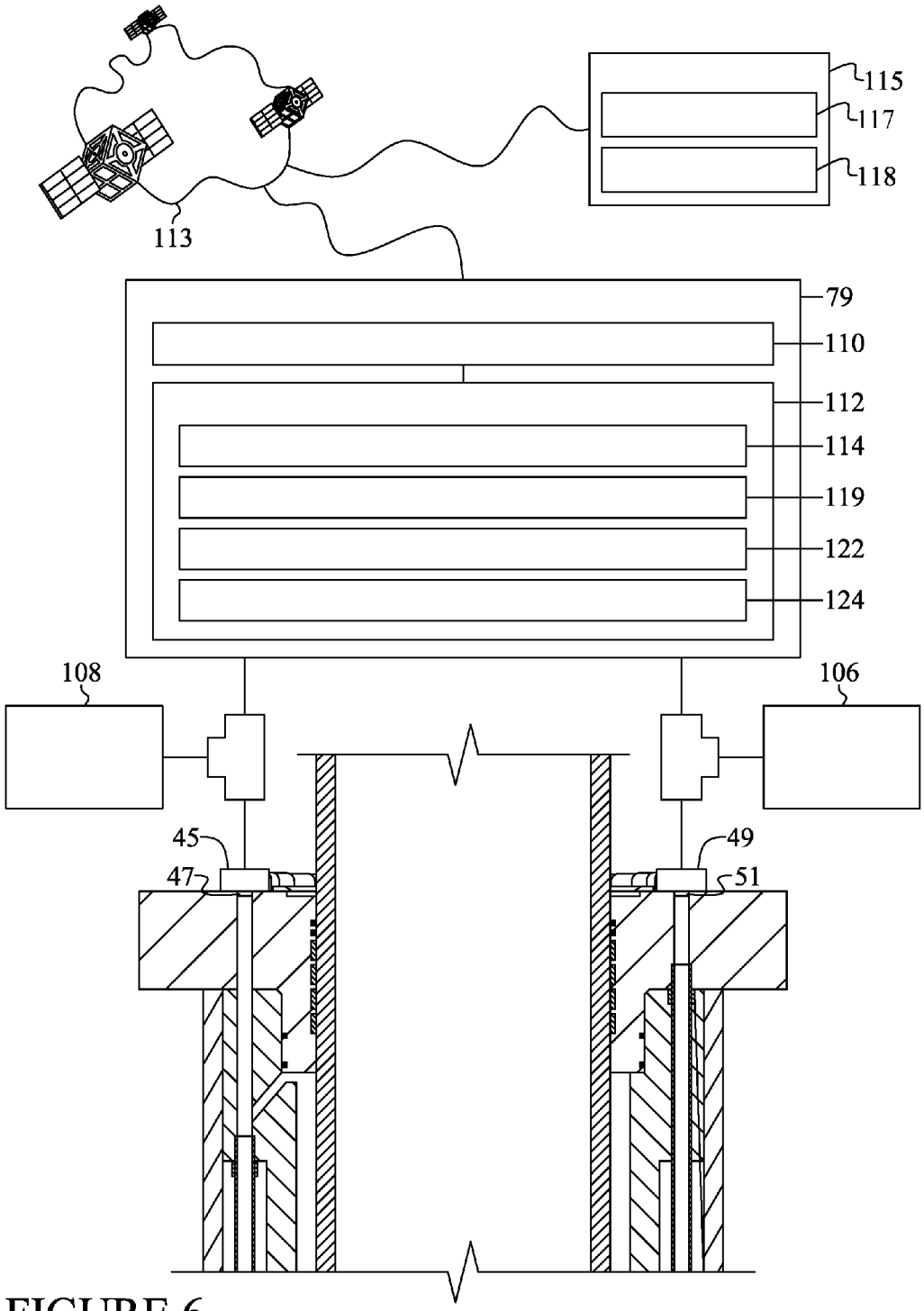
FIG. 6 is a detailed view of a top cutaway portion of a dual pressure cylinder with a controller.

FIG. 6 shows an embodiment with the top of the dual pressure cylinder with a low pressure access port 45 and a high pressure access port 49. Attached to the low pressure access port is a low pressure closable fitting 47. Attached to the high pressure access port is a high pressure closable fitting 51.

A high pressure sensor 106 is connected to the high pressure access port 49 and to a controller 79. A low pressure sensor 108 is connected to the low pressure access port 45 and to the controller 79.

In an embodiment, both of the high pressure access port and low pressure access port can be different ports from the fluid pathway and gas ports used to control the cylinders.

It can be contemplated that the controller has a controller processor 110 connected to controller data storage 112 with controller computer instructions 114 for opening or closing the fittings.

A client device 115 with client device computer instructions 118 for presenting an executive dashboard to allow simultaneous monitoring of a plurality of self contained dual pressure cylinders. The client device is shown in communication with the controller 79 through a network 113. The client device 115 can present the executive dashboard 117.

The controller data storage 112 can have controller computer instructions 122 to enable the storing of preset pressure limits for a tensioner assembly. The controller data storage can also have controller computer instructions 124 to compare sensed pressures to the preset pressure limits.

The controller data storage 112 can further have controller computer instructions 119 for providing an alarm to a client device when one or more of the dual pressure cylinders pressure falls below or exceeds a preset pressure limit.

Based on a comparison of the pressures of the dual pressure cylinders to the preset pressure limits stored in the data storage of the controller, the controller can determine whether the pressures are above or below the preset limits, can provide an alarm to a user, or can modify the pressures in the channels to conform to the preset limits.

Figure 7:
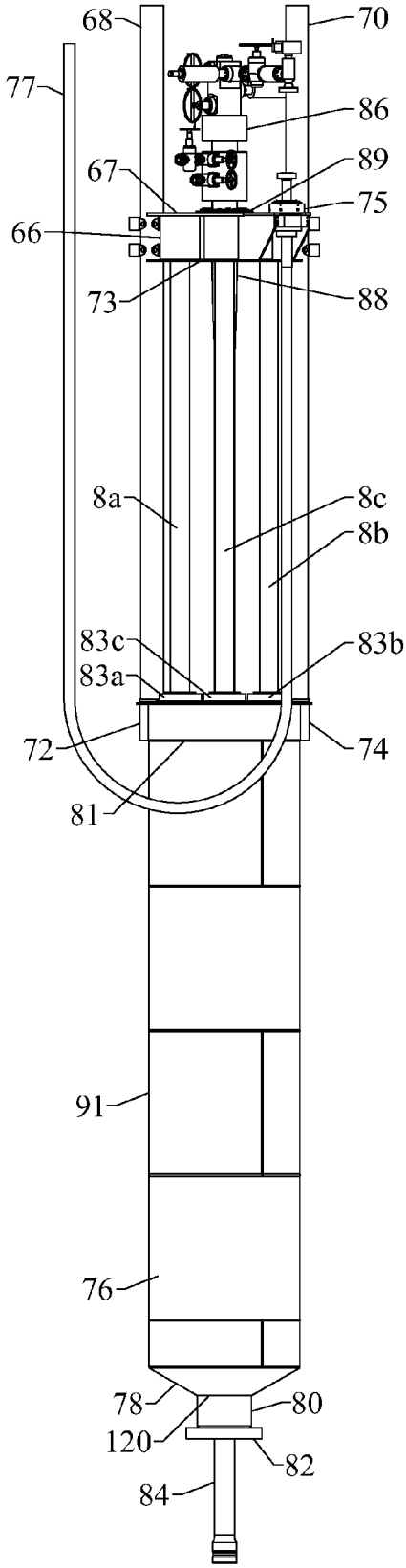
FIG. 7 is a side view of a tensioner assembly.

FIG. 7 is a side view of the tensioner assembly with a plurality of hydraulic dual pressure cylinders 8*a*, 8*b*, 8*c*. Also shown is a tensioner table 66 with a top side 67 and a bottom side 73.

Wellhead equipment 86, such as valving, ports, seals, and pipe, is secured to the top side of the tensioner cable. Also on the top side is an umbilical connection 75, which engages an umbilical 77 for providing communication and signals to another location.

A tension ring 89 is shown secured to the top side 67 between the top side and the wellhead equipment 86. The tensioner table bottom side 73 has a tension joint 88 secured to it.

A first guide post 68, which extends above and below the tensioner table 66, is shown secured to one side of the tensioner table. The first guide post is parallel to a second guide post 70, which also extends above and below the tensioner table 66 to provide support to a housing 76 that supports the cylinders for tensioning.

The first guide post 68 is supported by and attached to a first guide post holder 72, which secures to the top of the housing 76. The second guide post 70 is supported by and attaches to the second guide post holder 74.

Cylinder connections 83*a*, 83*b*, 83*c* are depicted on top of the housing 76 and between the first guide post holder 72 and the second guide post holder 74. The cylinder connections 83*a*, 83*b*, 83*c* are on the top end 81 of the housing 76. In this embodiment, the hydraulic dual pressure cylinders 8*a*, 8*b*, 8*c* with cylinder connections 83*a*, 83*b*, 83*c* are positioned in a circle, equidistantly disposed from each other.

FIG. 7 also shows the housing 76 having an outer sheath 91, which can be used to protect the hydraulic dual pressure cylinders from greenwater during a storm, such as a 100 year storm.

On an end of the housing 76 opposite the first guide post holder 72 and the second guide post holder 74, is a bottom cap 78 that slopes towards a central exit port 120. The sloping sides of the bottom cap 78 come together and provide a smaller diameter central exit port 120 than the diameter of the housing 76. A conductor 80 extends from the smaller diameter of the central exit port 120 to a flange connection 82 which meets a riser 84 from the oil well equipment.

Figure 8:
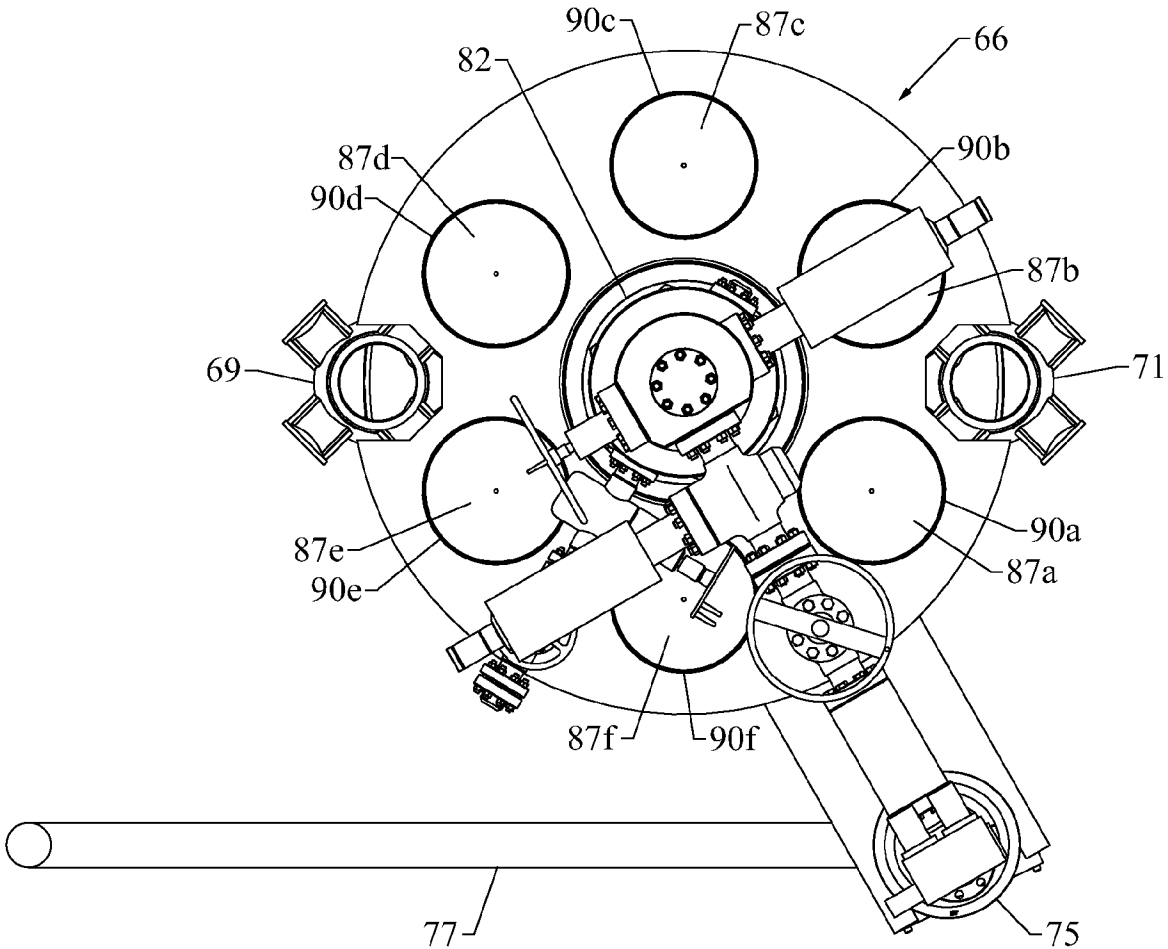
FIG. 8 is a top view of a tensioner table.

FIG. 8 is a top view of a tensioner table 66 with guide rods. A first side 69 of the tensioner table and a second side 71 of the tensioner table are shown. The flange connection 82 is depicted for connections to the oil well equipment.

In this view the load buckets 87*a*, 87*b*, 87*c*, 87*d*, 87*e*, 87*f* are shown over holes 90*a*, 90*b*, 90*c*, 90*d*, 90*e*, 90*f*. The load buckets can engage and support the hydraulic dual pressure cylinders.

The umbilical connection 75 is also viewable in this Figure, and is shown attached to the umbilical 77.

Figure 9:
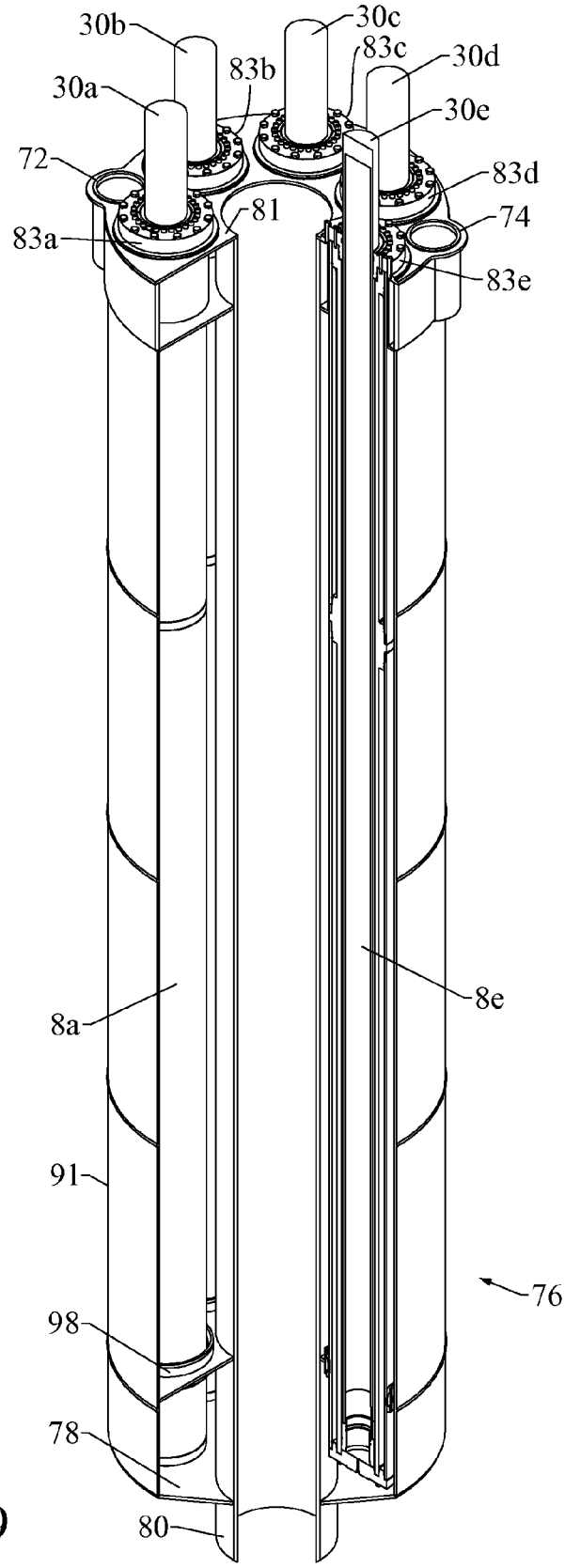
FIG. 9 depicts an isometric view of a tensioner assembly.

FIG. 9 shows a cutaway of an isometric view of the tensioner assembly. This view shows one and one half of two hydraulic dual pressure cylinders 8*a*, and half of 8*e* within the housing 76 with the outer sheath 91. At the top of the housing 76 is the first guide post holder 72 and second guide post holder 74, as well as four of the cylinder connections 83*a*, 83*b*, 83*c* 83*d*, 83*e*.

The housing 76 includes the outer sheath 91 connected to the top end 81 and the bottom cap 78.

The moveable hollow rods 30*a*, 30*b*, 30*c*, 30*d*, and half of 30*e* can be seen engaging the housing 76 and extending from the cylinder connections 83*a*, 83*b*, 83*c*, 83*d*, 83*e*.

A centralizer 98 and the conductor 80 are shown also shown in this Figure at the bottom of the housing 76.

Figure 10:
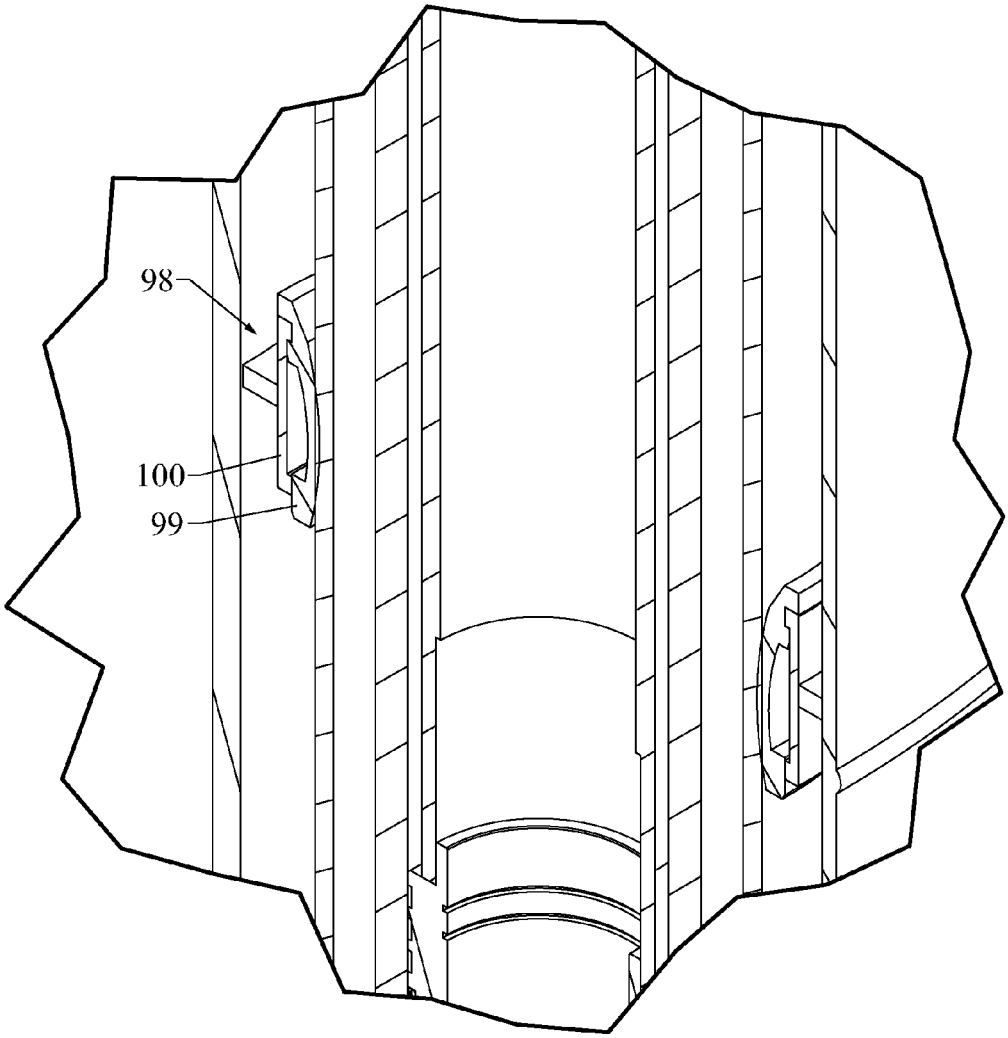
FIG. 10 depicts a detail of the centralizer.

FIG. 10 shows a detail of the centralizer 98 with a flexible insert 99 and a support back 100. Each connection for each hydraulic dual pressure cylinder can have a centralizer.

Figure 11:
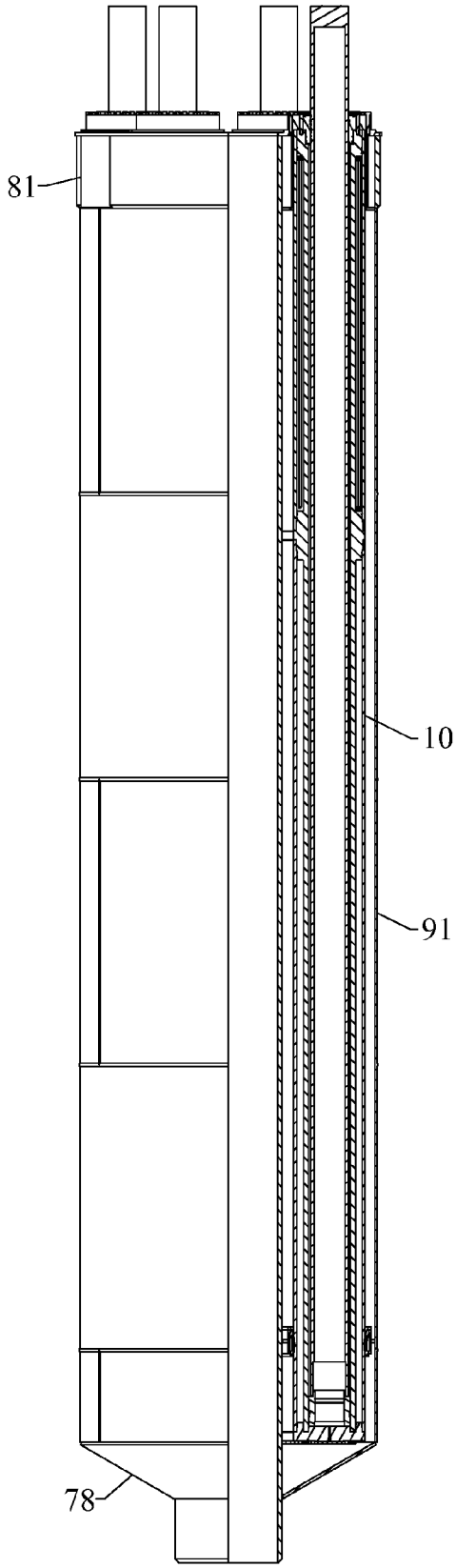
FIG. 11 is a side view of the tensioner assembly with a portion cut away.

FIG. 11 is a side view of the tensioner assembly with a portion cut away. This view has a cut away of the outer sheath 91 so that the operation of the pistons can be understood. The high pressure outer barrel 10 is shown with the top end 81 of the housing 76 and the bottom cap 78.

While these embodiments have been described with emphasis on the embodiments, it should be understood that within the scope of the appended claims, the embodiments might be practiced other than as specifically described herein.

What is claimed is:

1. A self contained dual pressure cylinder for use in tensioner assemblies for oil and natural gas floating vessels, the self contained dual pressure cylinder comprising:

a. a high pressure outer barrel surrounding an inner barrel, forming a high pressure gas reservoir in communication with a high pressure gas channel, wherein the high pressure gas reservoir is a space formed between the high pressure outer barrel and the inner barrel;

b. a low pressure outer barrel surrounding the inner barrel, forming a low pressure gas reservoir in communication with a low pressure fluid channel, wherein the low pressure outer barrel adjoins the high pressure outer barrel, wherein the low pressure gas reservoir is a space formed between the low pressure outer barrel and the inner barrel, wherein the low pressure fluid channel is connected to a low pressure fluid port, and wherein the low pressure fluid port comprises a low pressure compression area;

c. a hollow rod movably disposed within the inner barrel, wherein the hollow rod has a hollow rod first end for engaging a load bucket of a tensioner assembly, and further wherein the hollow rod has a chamber fluidly connected to the high pressure gas reservoir through the high pressure gas channel enabling the hollow rod to support a load;

d. a dual pressure capture plate for sealing the hollow rod inside the inner barrel, wherein the hollow rod has moveable rod wear bands;

e. a piston on a hollow rod second end opposite the tensioner assembly, to form the self contained dual pressure cylinder; and f. a low pressure seal adjacent to a low pressure/high pressure separator and a high pressure seal adjacent the low pressure/high pressure separator, wherein the low pressure/high pressure separator is static and does not engage the hollow rod, wherein the low pressure/high pressure separator provides a separation between the high pressure gas reservoir and the low pressure gas reservoir, wherein the self contained dual pressure cylinder is usable in oil and natural gas floating vessels.

2. The self contained dual pressure cylinder of claim 1, wherein the piston further comprises: a piston body with a plurality of moveable rod wear bands and a plurality of moveable rod seals for providing a seal between the piston body and the inner barrel.

3. The self contained dual pressure cylinder of claim 1, wherein the piston comprises a piston drain port, a piston end cap, a plurality of piston end cap fasteners holding the piston end cap to the inner barrel, at least one piston wear band, at least one piston seal adjacent to the piston wear band, and at least one piston seal groove for containing the at least one piston seal.

4. The self contained dual pressure cylinder of claim 1, wherein the high pressure gas channel has a pressure from 100 psi to 3600 psi.

5. The self contained dual pressure cylinder of claim 1, wherein a high pressure gas within the high pressure gas channel is selected from the group consisting of: nitrogen, air, helium, argon, and combinations thereof.

6. The self contained dual pressure cylinder of claim 1, wherein the low pressure fluid channel comprises from 20 percent to 70 percent liquid with the remainder of the low pressure fluid channel comprising a gas.

7. The self contained dual pressure cylinder of claim 6, wherein the gas in the low pressure fluid channel is selected from the group consisting of: nitrogen, air, helium, argon, and combinations thereof.

8. The self contained dual pressure cylinder of claim 6, wherein the liquid in the low pressure fluid channel is a member of the group consisting of: a liquid glycol, a hydraulic liquid, a mineral based liquid lubricant, a silicon liquid, a glycol based liquid lubricant, a white oil, a silicon oil, a mineral oil, and combinations thereof.

9. The self contained dual pressure cylinder of claim 1, further comprising a. a low pressure access port with a low pressure closable fitting;

b. a high pressure access port with a high pressure closable fitting;

c. a controller with a controller processor, a controller data storage for storing preset pressure limits, and controller computer instructions for opening or closing the high pressure and low pressure closable fittings; and d. a high pressure sensor disposed between the high pressure closable fitting and the controller and in communication with the controller, wherein the controller increases or decreases pressure within the high pressure gas channel based after comparing sensed pressures to preset pressure limits stored in the controller data storage.

10. The self contained dual pressure cylinder of claim 9, further comprising a low pressure sensor disposed between the low pressure closable fitting and the controller and in communication with the controller to increase or decrease pressure within the low pressure fluid channel after comparing sensed pressures to preset pressure limits stored in the controller data storage.

11. The self contained dual pressure cylinder of claim 9, wherein the controller processor is in communication with a network for remotely controlling pressure from at least one client device.

12. The self contained dual pressure cylinder of claim 11, further comprising client device computer instructions in the at least one client device for presenting an executive dashboard that allows simultaneous and continuous monitoring of a plurality of self contained dual pressure cylinders.

13. The self contained dual pressure cylinder of claim 1, wherein the high pressure outer barrel and the inner barrel are each made from a member of the group consisting of: a high strength low carbon alloy, a composite of carbon fiber, a synthetic fiber with an epoxy resin, and combinations thereof.

14. The self contained dual pressure cylinder of claim 1, wherein:

a. the high pressure outer barrel is made of a member of the group consisting of: a high strength low carbon alloy, a composite of carbon fiber, a composite of a synthetic fiber with an epoxy resin, and combinations thereof; and b. the inner barrel is made of a material different from the high pressure outer barrel, which allows the self contained dual pressure cylinder to have two different physical properties.

15. The self contained dual pressure cylinder of claim 1, wherein the high pressure gas channel has a diameter that is from 10 percent to 24 percent smaller than the low pressure fluid channel diameter.

16. The self contained dual pressure cylinder of claim 1, wherein the high pressure outer barrel is coated with a thermal sprayed aluminum or a marine paint with inorganic zinc primer for cathodic protection.

17. The self contained dual pressure cylinder of claim 1, wherein the low pressure fluid port extends from the low pressure fluid channel to the piston.

* * * * *